United States Patent [19]

Pettit, Jr et al.

[11] Patent Number: 4,696,855

[45] Date of Patent: Sep. 29, 1987

[54] MULTIPLE PORT PLASMA SPRAY APPARATUS AND METHOD FOR PROVIDING SPRAYED ABRADABLE COATINGS

[75] Inventors: Harold W. Pettit, Jr, West Palm Beach; Charles G. Davis, Jupiter; Frederick C. Walden, Jensen Beach, all of Fla.

[73] Assignee: United Technologies Corporation, Hartford, Conn.

[21] Appl. No.: 856,897

[22] Filed: Apr. 28, 1986

[51] Int. Cl.[4] ..... B05D 1/12

[52] U.S. Cl. ..... 428/312.8; 427/34; 427/201; 427/423; 427/426

[58] Field of Search ..... 428/457, 312.8; 118/310, 311; 420/34, 195, 201, 336, 423, 426

[56] References Cited

U.S. PATENT DOCUMENTS

| | | | |
|---|---|---|---|
| 2,423,490 | 7/1947 | Erhardt | 427/423 |
| 2,689,801 | 9/1954 | D'Alelio | 427/201 X |
| 3,020,182 | 2/1962 | Daniels | 154/43 |
| 3,352,492 | 11/1967 | Cape | 427/423 |
| 3,723,165 | 3/1973 | Longo et al. | 117/93.1 |
| 3,864,443 | 2/1975 | Hopkins | 427/201 X |
| 3,912,235 | 10/1975 | Janssen | 259/4 |
| 4,263,346 | 4/1981 | Sandell | 427/426 X |
| 4,299,865 | 11/1981 | Clingman et al. | 427/243 |
| 4,336,276 | 6/1982 | Bill et al. | 427/34 |
| 4,386,112 | 5/1983 | Eaton et al. | 427/34 |

*Primary Examiner*—Shrive P. Beck

*Attorney, Agent, or Firm*—James M. Rashid

[57] ABSTRACT

An apparatus and method are described for simultaneously thermal spraying at least two types of powders onto a substrate, wherein both powder types are carried by a single spray stream and impacted upon the substrate. According to the invention, the different powder types are injected into the spray stream through separate powder ports in such a manner that there is substantially no mixing of the powder types in the spray stream. The spray system and substrate being sprayed are moved relative to each other to produce a homogeneous sprayed powder deposit.

6 Claims, 2 Drawing Figures

MULTIPLE PORT PLASMA SPRAY APPARATUS AND METHOD FOR PROVIDING SPRAYED ABRADABLE COATINGS

CROSS REFERENCE

Reference is directed to the copending and commonly assigned U.S. patent application Ser. No. 815,616, "Abradable Structure and Method for Making the Same", by S. T. Narsavage et al, filed on Jan. 2, 1986.

TECHNICAL FIELD

The present invention relates to a method for providing sprayed coatings on a substrate. More specifically, it relates to a method for simultaneously thermal spraying two or more types of powders on a substrate using a single spray device.

BACKGROUND ART

Gas turbine engines and other turbomachines have rows of blades which rotate within a generally cylindrical case. As the blades rotate, their tips move in close proximity to the case. One way to improve the efficiency of such machines is to minimize the leakage of the working fluid between the blade tips and the case. As has been known for some time, this leakage may be reduced by blade and seal systems, in which the blade tips rub against an abradable seal attached to the interior of the engine case.

Porous metal structures are particularly useful for abradable seals, since they wear at a favorable rate when contacted by rotating blades. One method for making porous seals is to plasma spray a mixture of metal and polymer powder particles, generally according to the teachings of Longo in U.S. Pat. No. 3,723,165. However, when spraying a mixture of two or more types of powders as in Longo, it may be difficult to maintain the particles in a homogeneous mixture if the density or size of the particles differs, as discussed in U.S. Pat. No. 3,912,235 to Janssen. One attempt to overcome this problem is described in U.S. Pat. No. 4,386,112 to Eaton et al, wherein metal and ceramic powder particles are injected separately into the plasma stream, but in such a manner that the particles mix with each other in the spray stream. U.S. Pat. Nos. 3,020,182 to Daniels, 4,299,865 to Clingman et al, and 4,336,276 to Bill et al are also representative of the state of the art.

Notwithstanding the advanced state of plasma spraying technology, control over the quality and reproduceability of abradable seals applied according to prior art techniques has been difficult. Accordingly, improved methods of seal fabrication are sought.

DISCLOSURE OF THE INVENTION

According to the invention, powder particles of at least two different powder types are deposited onto a substrate by a single thermal spray apparatus, in such a manner that there is little mixing of the different powder types in the high temperature gas stream. More specifically, the different powder particle types are simultaneously injected through separate powder ports and at independently controlled feed rates into a stream of high temperature, high velocity gases; the powder ports are arranged and the powder feed rates adjusted such that the powder particles of a first powder type are carried along the central, hotter portion of the stream of gases and impact upon the substrate, while at the same time, the particles of a second powder type are carried along the outer, cooler portion of the stream of gases and impact upon the substrate. Due to their separate paths of travel, there is little mixing of the first powder particles with the second powder particles in the gas stream; a composite, homogeneous deposit is achieved by moving the substrate relative to the stream of gases while the powders are being injected into the stream.

Spraying the powders so that there is little mixing of the powder particles in the gas stream has produced deposits having significantly improved properties compared to deposits produced when the powders are mixed before they reach the stream as in the Longo patent, or mixed in the stream as in the Eaton et al patent.

The invention has been particularly useful in simultaneously spraying powders having different melting temperatures, such as metal and plastic, of the type described in U.S. Ser. No. 815,616. The metal particles are injected into the hot portion of the stream, and their dwell time in the stream is longer than the dwell time of the plastic particles, which are injected into the cool portion of the stream. Neither the metal nor the plastic particles are excessively vaporized. The microstructure of the as-sprayed deposit exhibits a uniform distribution of polymer particles within a metal matrix. After the deposition process, the deposit is heated at a temperature which causes the polymer to volatilize, which results in a porous metal structure.

The foregoing and other objects, features and advantages of the present invention will become more apparent from the following description of preferred embodiments and accompanying drawings.

BEST MODE FOR CARRYING OUT THE INVENTION

Figure 1:
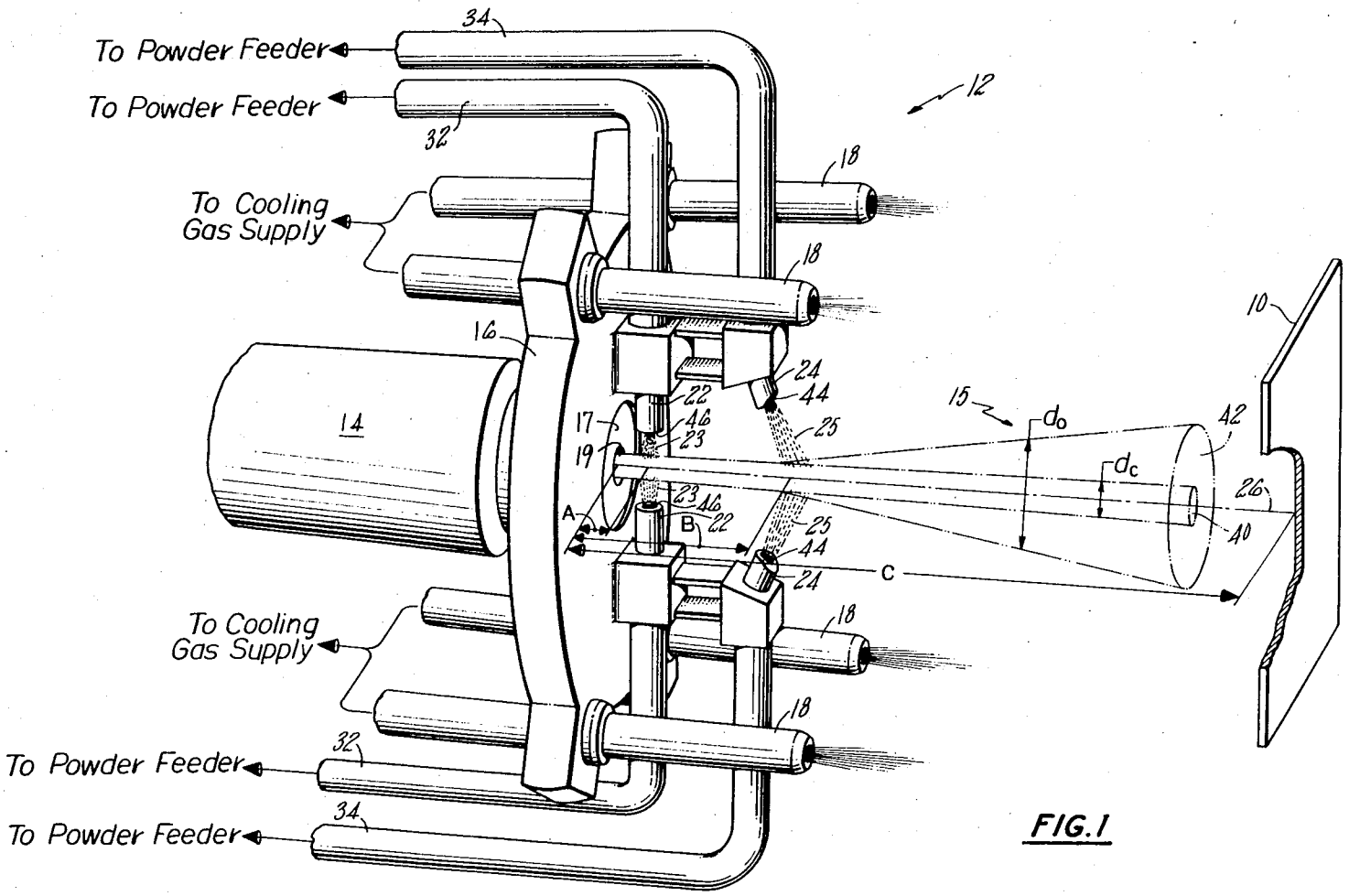
FIG. 1 is a schematic view showing an apparatus useful in the practice of the present invention.

The present invention relates to a method for simultaneously thermal spraying two or more different types of powders onto a substrate with a single spray apparatus. For the sake of simplicity, the discussion which follows will be directed towards the thermal spraying of only two types of powders. The term thermal spraying is meant to describe plasma spraying, combustion spraying, and other similar processes for the deposition of powders onto a substrate.

The invention is most easily discussed with reference to FIG. 1. In the Figure, the substrate to be coated is represented by the reference numeral 10, and the apparatus used to deposit the powders onto the substrate 10 is represented by the reference numeral 12. Not shown in the Figure, but part of the spray system, are the power supply means and apparatus associated therewith; means for moving the substrate 10 and the apparatus 12 relative to each other are also not shown. The specific manner in which the substrate 10 and apparatus 12 are moved is not critical to the invention. Either the substrate 10 may be moved while the apparatus 12 is kept in a fixed position, the apparatus 12 moved while the substrate 10 is kept in a fixed position, or the substrate 10 and apparatus 12 both moved. Those skilled in the art will be able to adapt appropriate moving means to the spray system in whatever manner is best suited to meet the needs of the particular deposition process.

Referring again to the Figure, the apparatus 12 includes a gun assembly 14. For purposes of this discussion, the gun assembly 14 is of the plasma arc type. As is known to those skilled in the art, in a typical plasma arc gun assembly 14, a high temperature electric arc is generated between spaced apart electrodes. Primary and secondary gases, e.g., helium, argon, or nitrogen, or mixtures thereof, pass through the arc, and are ionized to form a high temperature, high velocity plasma plume or stream 15 which extends in a downstream direction from the gun nozzle 19 towards the substrate 10. In order to withstand the high temperature of the plasma stream 15, the gun nozzle 19 is typically water cooled.

A fixturing bracket 16 is attached to the front end 17 of the gun assembly 14 by means not shown in the Figure. Attached to the bracket 16 are nozzles 18 which spray a stream of cooling gases onto the substrate 10 to prevent the substrate 10 from being excessively heated by the plasma stream 15. Useful cooling gases include e.g., nitrogen, argon, or air. As is discussed in more detail below, powder ports are arranged to direct separate streams of powder particles into the plasma stream 15. First powder ports 22 direct particles of a first type of powder 23 into the stream 15, and second powder ports 24 direct particles of a second type of powder 25 into the stream 15. The Figure shows two first powder ports 22 about 180° from each other, and two second powder ports 24 about 180° from each other, and generally radially aligned with the position of the first powder ports 22. However, the number of powder ports 22, 24, and their relative position is not critical to the invention. The first powder ports 22 are axially upstream of the second powder ports 24, and are constructed and arranged to inject the first powder particles 23 into the stream 15 at a distance A from the front end 17 of the gun assembly 14; the second powder ports 24 inject the second powder particles 25 into the stream 15 at a downstream distance B. The distance between the gun front end 17 and the substrate 10 is designated C. As a result of the arrangement of the first and second powder ports 22, 24, and the rate and velocity in which the powder particles 23, 25 are separately injected into the stream 15, there is little mixing of the particles 23, 25 in the stream 15. Furthermore, the residence or dwell time of the second powder particles 25 in the plasma stream 15 is less than the dwell time of the first powder particles 23. The significance of this will be discussed in further detail below.

Powder particles 23, 25 are delivered to the powder ports 22 and 24 by lines 32 and 34, respectively. The lines 32, 34 are pressurized with a carrier gas which is typically argon. The two feed lines 32 are each connected to a separate powder feeder which contain the first powder particles 23 and the two feed lines 34 are each connected to a separate powder feeder which contain the second powder particles 25. All powder feeders are independently controllable to deliver powder at a specified rate and velocity to and through their respective powder ports.

The plasma stream 15 spreads radially outwardly from the stream axis 26 as the downstream distance from the gun front end 17 increases. The resulting overall shape of the stream 15 is similar to that of a tapered cylinder. Observations have indicated that the plasma stream 15 actually comprises a central stream of moving gases 40 and a radially outer, peripheral stream of moving gases 42. The diameter $d_c$ of the central stream 40 increases only slightly as the downstream distance increases, while the diameter $d_o$ of the outer stream 42 increases to a much greater extent as the downstream distance increases. The temperature as well as the velocity of the gases within the central plasma stream 40 is considerably higher than the temperature and velocity of the gases in the outer stream 42.

The operating parameters of each first powder feeder are selected to inject a substantially continuous flow of powder particles of the first powder type through its respective first powder port 22 and directly into the central stream of gases 40. The first powder particles 23 are carried by the central stream 40 until they impact upon the substrate 10. Tests have shown that there is little radial deviation of the first powder particles 23 outside of the central stream 40, apparently due to their relatively high axial momentum in the stream 15, although other forces may be acting to produce this effect.

As is seen in FIG. 1, the outlet end 44 of each of the second powder ports 24 is radially outward of, as well as axially downstream of, the outlet end 46 of each of the first powder ports 22. The operating parameters of each second powder feeder are selected to inject the second powder particles 25 into the plasma stream 15 such that they do not enter the central stream of gases 40. Rather, the second powder particles 25 are carried by the outer stream of gases 42 until they impact upon the substrate 10. Whether the different powder particles 23, 25 are properly injected into their respective plasma stream portion 40, 42 and are carried by such stream portion to the substrate 10, can be determined by evaluating the distribution of the powder particles 23, 25 in the stream 15. A method for making such an evaluation is described below, in the discussion of FIG. 2.

The outer stream of gas 42, carrying the second powder particles 25, swirls in a circular fashion around the central stream of gases 40 and first powder particles 23 as they move in the downstream direction toward the substrate 10. Because the first powder particles 23 and second powder particles 25 are carried to the substrate 10 by separate gas streams 40, 42, the particles 23, 25 do not mix to any appreciable degree within the plasma stream 15. This is unlike prior art plasma spray processes, wherein the different powder types are deliberately mixed with each other within the plasma stream or are mixed in a mixing chamber which then delivers the powders through a singular powder port into the plasma stream.

Figure 2:
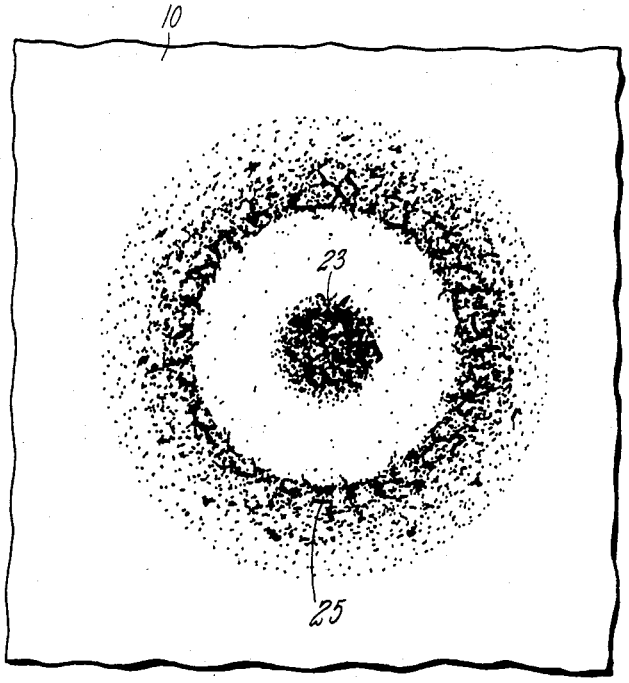
FIG. 2 schematically shows the distribution of metal and polymer particles after they have been sprayed onto the substrate.

FIG. 2 shows that there is a lack of substantial mixing of the first and second powder particles 23, 25 respectively, in the plasma stream 15. The Figure is a schematic representation of a photograph of a substrate 10 which was sprayed according to the invention for one second. This was accomplished by placing a shutter type device between the gun assembly 14 and the substrate 10, and opening the shutter for one second while the powders 23, 25 were being injected into the plasma stream 15. As is seen in the Figure, the first powder particles 23 remained in the central stream of gases 40 and the second powder particles remained in the radially outer portion of the stream of gases 42, with only a small amount of mixing of the two powder types. (It should be noted that the powder distribution pattern shown in FIG. 2 was produced with a gun assembly 14 which had only one first powder port 22 and one second powder port 24. A somewhat different pattern is produced when using two first powder ports 22 and two second powder ports 24. However, there is still a lack of substantial mixing of the first and second powder types.)

The fact that most of the powders remain in their respective portion of the plasma stream is significant in assuring process and product repeatability. By adjusting the operating parameters of the plasma gun assembly, the characteristics (temperature, velocity, etc.) of the central and outer portions of the stream 40, 42, respectively are closely controlled to the optimum range for spraying the different powder types. In other words, the characteristics of the central portion of the stream are adjusted to produce the best conditions for spraying the first powder type, while at the same time the characteristics of the outer portion of the stream are adjusted to produce the best conditions for spraying the second powder type.

The present invention is particularly useful in the thermal spray deposition of powder types which have different melting temperatures and densities to form a porous metal structure for turbomachinery such as gas turbine engines. In such deposition, the first powder type may be a metallic, oxidation resistant material such as an MCrAlY, where M is nickel, cobalt, iron, or mixtures thereof. Such compositions are described in, e.g., U.S. Pat. Nos. 3,676,085, 3,928,026, and 4,419,416; the contents of each of these patents is incorporated by reference. Some MCrAlY compositions are modified to contain additions of noble metals, refractory metals, hafnium, silicon, and rare earth elements; see, e.g., U.S. Pat. No. 4,419,416. One particularly useful refractory metal modified MCrAlY composition is described in copending and commonly assigned U.S. Ser. No. 815,616. More simple metallic compositions may also be sprayed according to the invention, such as Ni-Cr alloys. The second powder type which may be sprayed with the metal powder to produce the porous structure is a decomposable polymer. After the metal and polymer powders have been applied onto the substrate, the coated component is heated at a temperature which is sufficient to volatilize the polymer, which results in a porous metal structure which is particularly useful as an abradable seal for gas turbine engines. Seals produced according to the invention have shown superior properties compared to prior art seal materials.

It is preferred that the metallic powder be produced by rotary atomization or rapid solidification rate (RSR) processing, such as described in, e.g., commonly assigned U.S. Pat. Nos. 4,178,335 and 4,284,394. Compared to powders produced by other techniques, powders produced by the RSR process are, in general, more uniform in size, generally spherical in shape, and have a smoother surface finish. Such powders also flow through powder feeders and associated equipment more readily than do irregularly shaped and sized powder particles. Once in the central portion of the plasma stream, such smooth, uniformly sized and shaped particles are all heated to about the same temperature, which results in the spray process and the product produced thereby being more repeatable than those of the prior art. To obtain even greater process repeatability, the polymer powder particles should also be uniform in size and shape, and have a smooth finish.

As an example of the invention, refractory modified MCrAlY powder particles which were produced by RSR processing were sprayed with polymethylmecacrylate particles to produce a deposit which, with post-coating treatment (described below), has particular use as an abradable seal for gas turbine engines. The polymer powder particles were purchased from E. I. duPont Company (Wilmington, DEL. USA) as Lucite ®Grade 4F powder; they were smooth in texture, spherical in shape, and within the size range (diameter) of about 60–120 microns. The metallic powder particles were also smooth spheres, and about 50–90 microns in size. The density of the polymer and metallic particles was about 0.9 g/cc and 8.6 g/cc, respectively.

The polymer and metal particles were fed by separate Plasmatron 1250 series powder feeders (Plasmadyne Incorporated, Tustin, CALIF. USA) to a plasma spray system comprising a Metco 7 M gun and Metco 705 nozzle (Metco Incorporated, Westbury, N.Y. USA). Referring to FIG. 1, the nozzle to metal injection point distance A, was about 0.55 cm; the nozzle to polymer injection point distance B, was about 3.3 cm; and the nozzle to substrate distance C, was about 18 cm. The radial distance between the first powder port outlet end 46 and the plasma stream axis 26 was about 0.7 cm; the radial distance between the second powder port outlet end 44 and the stream axis 26 was about 1.5 cm. Specific spray parameters used to deposit the powder are presented in Table I. The use of such parameters produced a spray pattern similar to that shown in FIG. 2.

TABLE I

Spray Parameters to Produce Metal-Polymer Powder Deposit

| | |
|---|---|
| Power Input (kw) | 20.3–21.7 |
| Primary Gas Flow (scmh) | 1.4–2.1 |
| Secondary Gas Flow (scmh) | 0.3–1.0 |
| Carrier Gas Flow (scmh) | 0.1–0.2 |
| Metal Powder Feed Rate (g/min) | 50.0–70.0 |
| Polymer Powder Feed Rate (g/min) | 8.0–12.0 |
| Gun to Substrate Angle | ≦20° to normal |

Metallographic examination of deposits sprayed with the parameters of Table I had a microstructure characterized by about one-third metallic particles, one-third polymer particles, and one-third porosity. The morphology of the particles indicated that most had been softened by the heat of the plasma stream. There was not an excessive amount of powder vaporized by the plasma, as evidenced by a comparison of the amount of powder injected into the spray stream with the amount of powder actually deposited on the substrate. In prior art spray techniques, wherein the metal and polymer powders are both carried by the central portion of the plasma stream, it has been observed that a significant amount of the polymer particles are vaporized which adversely affects the repeatability of the process and product produced thereby. Such excessive vaporization is due to the fact that the temperature at the central portion of the stream greatly exceeds the vaporization temperature of the polymer. Thus, because the polymer particles travel in the cooler, radially outer portion of the stream in the invention technique, the amount of polymer particle vaporization is significantly decreased compared to prior art techniques.

After the spray process, the metal-polymer deposit is treated to eliminate the polymer particles, which results in a porous metal structure. The preferred method is to heat the deposit in a nonoxidizing atmosphere to about 355°–385° C. for two hours. This temperature is high enough to cause complete volatilization of the polymer. The polymer may also be removed chemically with appropriate solvents or the like. After the polymer is removed, the sprayed deposit is about two-thirds porous.

Such porous sprayed MCrAlY deposits, produced according to the teachings of the invention, have exhibited markedly improved properties as an abradable seal material as compared to prior art seal materials. Useful seal materials must be abradable, i.e., they must easily disintegrate in a friable mode when contacted by a high speed moving part, such as the tip of a rotating blade in a gas turbine engine, or the tip of a knife edge labyrinth type seal. The seal material must also remain intact when exposed to particulate erosion and other mechanical stresses. In laboratory tests as well as actual engine tests, the porous metal abradable produced according to the invention exhibited better abradability and better erosion resistance compared to prior art seals.

Although this invention has been shown and described with respect to a preferred embodiment, it will be understood by those skilled in the art that various changes in form and detail thereof may be made without departing from the spirit and scope of the claimed invention.

We claim:

1. A method for providing a sprayed powder deposit on a substrate, the deposit characterized by a homogeneous mixture of first and second powder particles, the method comprising the steps of:

(a) generating a high velocity and high temperature stream of gases, and directing the stream of gases onto the substrate, wherein the central portion of the stream is hotter than the outer portion of the stream;

(b) injecting particles of a first powder type into the stream of gases such that they are carried along the central portion of the stream and are impacted upon the substrate;

(c) simultaneously injecting particles of a second powder type into the stream of gases such that the second powder particles are carried along the outer portion of the stream and are impacted upon the substrate without substantial mixing in the stream with the first powder particles; and (d) moving the stream of gases containing the first and second powder particles relative to the substrate to form a homogeneous powder deposit on the substrate.

2. The method of claim 1, wherein the first powder particles are metallic, and the second powder particles are polymer, and further comprising the step of removing the polymer particles from the sprayed deposit to form a porous sprayed metal deposit.

3. The article made according to the method of claim 2.

4. The method of claim 2, wherein the metallic powder particles are selected from the group consisting of nickel, cobalt, and iron base alloys.

5. The method of claim 4, wherein the metal powders are selected from the group consisting of NiCr, MCrAlY, and refractory modified MCrAlY alloys.

6. A method for fabricating a sprayed powder deposit containing metal and plastic powder particles, wherein the powder particles are carried in a single plasma spray stream which impacts them upon a substrate, the plasma spray stream characterized by a hot central stream of gases and a cooler outer stream of gases, the improvement which comprises injecting the metal and plastic powder particles into the spray stream such that the metal powder particles are carried by the central stream of gases and the plastic powder particles are carried by the outer stream of gases and there is substantially no mixing of the metal powder particles in the central stream of gases with the plastic powder particles in the outer stream of gases.

* * * * *